US005270826A

United States Patent [19]

Fowler

[11] Patent Number: 5,270,826

[45] Date of Patent: Dec. 14, 1993

[54] IMPLOSION-RESISTANT CATHODE-RAY TUBE HAVING IMPLOSION PROTECTION MEANS WITH INTEGRAL MOUNTING LOOPS

[75] Inventor: Jonathan B. Fowler, Lancaster, Pa.

[73] Assignee: Thomson Consumer Electronics, Inc., Indianapolis, Ind.

[21] Appl. No.: 920,726

[22] Filed: Jul. 28, 1992

[51] Int. Cl.[5] ..... H01N 5/65

[52] U.S. Cl. ..... 358/246; 358/245; 358/247; 358/248; 358/255; 220/2.1 A; 220/2.3 A; 313/482

[58] Field of Search ..... 358/245, 246, 247, 248, 358/255; 220/2.1 A, 2.3 A; 313/482

[56] References Cited

U.S. PATENT DOCUMENTS

| | | | |
|---|---|---|---|
| 4,236,184 | 9/1978 | Palac et al. | 358/245 |
| 4,295,574 | 10/1981 | Nakazima et al. | 220/2.1 A |
| 4,360,837 | 11/1982 | Kreidler et al. | 358/246 |
| 4,544,955 | 1/1984 | Swank et al. | 358/246 |
| 4,858,016 | 8/1989 | Suehiro et al. | 358/246 |
| 5,036,577 | 11/1989 | Swank | 29/446 |
| 5,053,880 | 10/1991 | Swank | 358/245 |
| 5,055,934 | 10/1991 | Swank | 358/246 |
| 5,057,929 | 9/1991 | Hermann | 358/246 |
| 5,064,394 | 11/1991 | Swank | 445/8 |
| 5,216,513 | 7/1991 | Swank | 358/246 |

*Primary Examiner*—Edward L. Coles, Sr.
*Assistant Examiner*—John Ning
*Attorney, Agent, or Firm*—Joseph S. Tripoli; Dennis H. Irlbeck; Vincent J. Coughlin Jr.

[57] ABSTRACT

An implosion-resistant cathode-ray tube has an evacuated envelope with a faceplate panel which includes a substantially rectangularly-shaped viewing portion that extends to a peripheral sidewall. The sidewall has corners and oppositely disposed flattened portions. An implosion protection band, having a predetermined width, extends around the sidewall. A plurality of mounting loops are formed in the implosion protection band, in the direction of the width, to accommodate mounting bolts. Each of the mounting loops is closed adjacent to the sidewall to ensure the structural integrity of the implosion protection band.

16 Claims, 5 Drawing Sheets

IMPLOSION-RESISTANT CATHODE-RAY TUBE HAVING IMPLOSION PROTECTION MEANS WITH INTEGRAL MOUNTING LOOPS

The invention relates generally to implosion protection means for a cathode-ray tube (CRT) and, more particularly, to an implosion protection band of either the shrinkfit or the rimband type having mounting loops formed across the width of the band to accommodate mounting hardware for attaching the tube within a housing, such as a television receiver cabinet.

BACKGROUND OF THE INVENTION

A CRT is evacuated to a very low internal pressure and accordingly is subjected to the possibility of implosion due to the stresses produced by atmospheric pressure acting on all surfaces of the tube. This problem has been addressed in the art by providing the CRT with an implosion protection band. Such a band is used to apply a compressive force to the sidewall of the CRT to redistribute some of the faceplate forces. The redistribution of the faceplate forces decreases the probability of an implosion of the tube by minimizing tension in the corners of the faceplate. An implosion protection band is also beneficial because it improves the impact resistance of the tube. Glass in compression is stronger than glass which is in tension and the band causes compression in faceplate areas which otherwise would be in tension. Additionally, in the event of an implosion, the redistributed stresses cause the imploding glass to be directed toward the back of the cabinet in which the tube is mounted, thereby substantially reducing the probability of someone in the vicinity of the imploding tube being injured.

Mounting lugs, either integral with, attached to, or disposed between the band and the tube sidewall are used to support the tube within the cabinet. Typically, the mounting lugs are positioned at the corners of the tube and aligned along the faceplate diagonals, although other placements of the mounting lugs are known. One drawback of such lugs is that as CRT's are produced in larger sizes, especially with diagonal dimensions in excess of 75 cm, the tube weight increases and puts considerable stress on the mounting lugs. Lugs which are attached to the surface of the implosion protection band, for example by welding, are prone to failure unless the weld is carefully made; however, it is difficult to inspect the quality of such welds without destructively testing the welded lug-band assembly. To overcome this problem, it is known to manufacture bands with integral lugs. One such structure is shown in U.S. Pat No. 4,295,574 issued to Nakazima et al. on Oct. 20, 1981. The patent discloses a shrinkfit band, formed flat, having integral lugs positioned along the band so that the lugs will be located at the corners of the tube, when the band is attached to the tube and the lugs are bent out of the plane of the band. A drawback of such a structure is that since the lugs must be bent out of the plane of the band, the material must be soft enough to permit the bending; however, the mechanical strength of such integral lugs is suspect, when used for heavy, large size tubes.

U.S. Pat. No. 5,055,934, issued to H. R. Swank on Oct. 8, 1991 overcomes the aforementioned problems by positioning the lugs between the band and the tube sidewall, within concavities formed in the band. The lugs are then secured to the overlying band. The lugs can be fashioned of material suitable for supporting even the largest tubes. One drawback of this structure is that the use of separate lugs increases the cost of the tube assembly over tube assemblies using bands in which the lugs are integral therewith.

A need thus exists for an implosion prevention structure having the cost effectiveness of a band with integral lugs but having structural integrity sufficient to support the present types of large tubes.

SUMMARY OF THE INVENTION

An implosion-resistant cathode-ray tube has an evacuated envelope with a faceplate panel which includes a substantially rectangularly-shaped viewing portion that extends to a peripheral sidewall. The sidewall has corners and oppositely disposed flattened portions. Implosion protection means, having a predetermined width, extend around the sidewall. A plurality of mounting loops are formed in the implosion protection means, in the direction of the width, to accommodate mounting means. Each of the loops is closed adjacent to the sidewall to ensure the structural integrity of the implosion protection means.

DETAILED DESCRIPTION OF THE PREFERRED EMBODIMENTS

Figure 1:
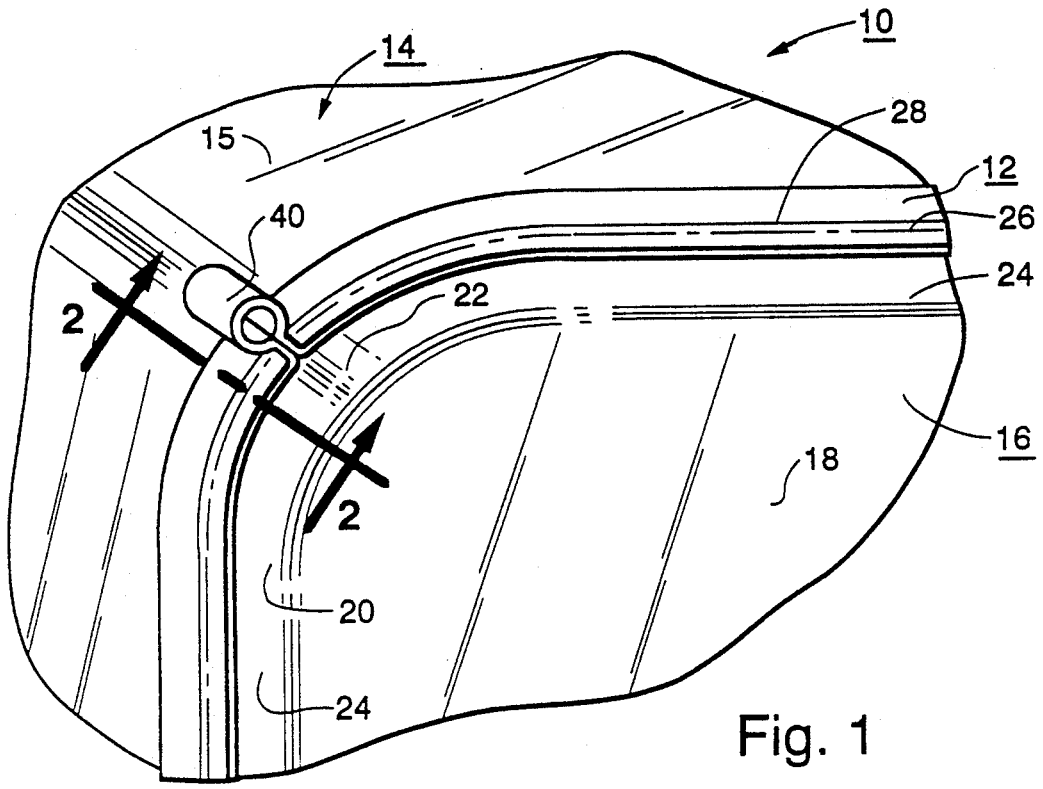
FIG. 1 is a partial perspective view of a forward portion of a CRT showing one embodiment of a shrinkfit implosion protection band having integral mounting loops formed in the corners thereof and extending across the entire width of the band.
Figure 2:
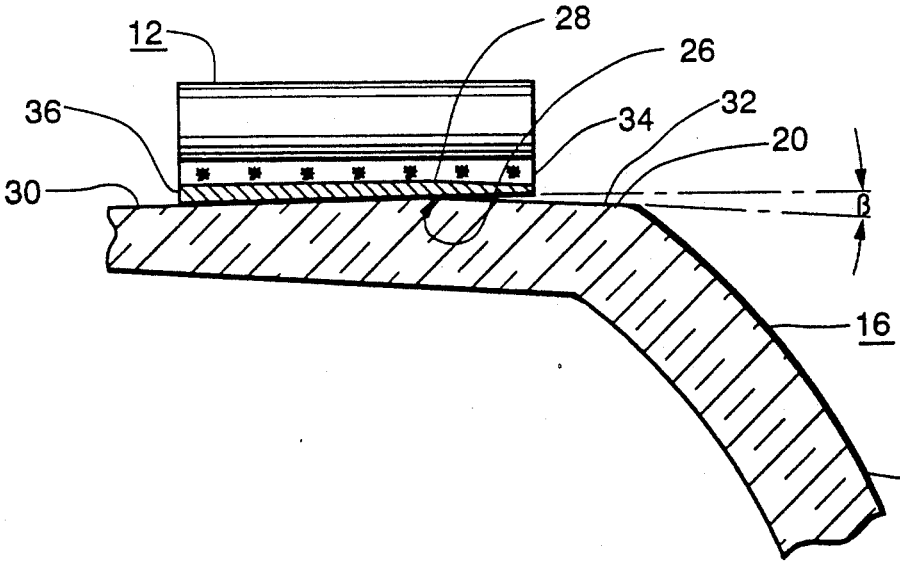
FIG. 2 is a sectional view taken along line 2—2 of FIG. 1.
Figure 3:
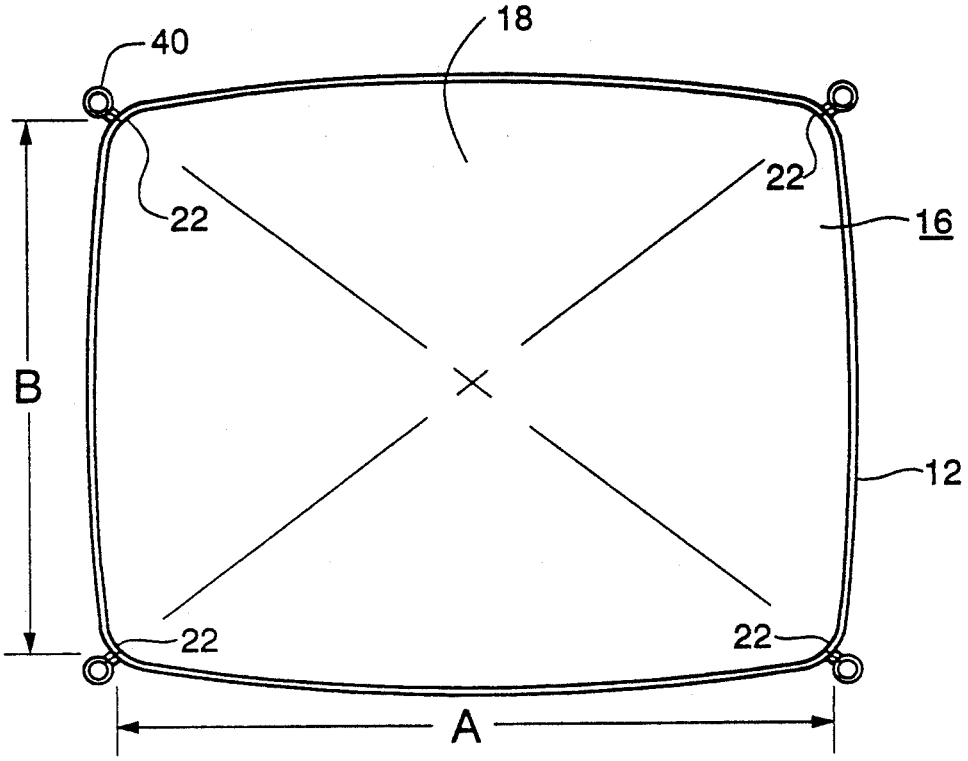
FIG. 3 is a front elevation view illustrating the viewing portion of the CRT faceplate and the shrinkfit implosion protection band shown in FIG. 1.

FIGS. 1–3 show an implosion-resistant CRT 10 having an implosion protection shrinkfit band 12. The tube 10 comprises an evacuated envelope 14 including a funnel 15 with a faceplate panel 16 sealed thereto. The panel 16 includes a substantially rectangularly-shaped viewing portion 18 extending to a peripheral sidewall 20. The sidewall 20 has four corners 22 extending into flattened portions 24.

The faceplate panel 16 is produced by molding glass in a two part mold (not shown). Accordingly, the sidewall 20 of the faceplate panel has a convex seam 26, commonly called the mold match line, which is formed where the two parts of the mold meet. Additionally, the sidewall of the faceplate panel is thicker where it joins the viewing portion 18 than it is at the open end which mates with the funnel 15. The angled sidewall improves the molding process and eases extraction of the molded glass panel from the mold. For this reason glass forward of the mold match line 26 is offset and lies at a small angle, $\beta$, with respect to the portion of the sidewall which joins the faceplate. This angle typically is on the order of 5.5°, for example.

The shrinkfit band 12 typically is manufactured by forming a strip of steel into a substantially rectangular loop with rounded corners and joining the two ends of the strip together. The long sides of the band are designated A and the short sides B. For present standard tube sizes the long side-short side ratio is 4:3; however, the invention is not limited thereto and may, for example, be utilized on tubes having a long side-short side ratio of 16:9. The periphery of the band loop is slightly smaller than the periphery of the faceplate panel 16. The band is heated to approximately 300° to 500° C. and the band expands to dimensions permitting the loop to be slipped around the sidewall 20 and aligned with the mold match line 26 of the faceplate panel 16. As the band cools it shrinks and tightly surrounds the faceplate panel thereby applying the necessary implosion protection compression to the sidewall. The compressive force can be accurately controlled by controlling the yield point and thickness of the band. The corners of the band 12 seat against the corners 22 of the sidewall 20 first during cooling because they are the first contact points. The rest of the band 12 then settles against the flattened portions 24 of the sidewall 20. As the band cools, almost all forces are directed through the band into the blend areas where the straight sidewall blends into the curved corners of the faceplate panel 16. The forces are thus transferred to the panel corners 22 and into the faceplate panel 16. Because the corners of the band 12 are in contact with the corners 22 of the sidewall 20, there is substantially no movement of the band, and the long sides of the band can initially adjust themselves and balance the forces. A substantial portion of the strain is thus concentrated in the corner blend areas and these forces exceed the yield point of the band metal, thereby placing a controlled compressive force on the corners of the shrinkfit band 12 and through the band into the corners 22 of the faceplate panel 16. These compressive forces offset tension forces which are produced on the faceplate corners by atmospheric pressure when the tube 10 is evacuated.

FIG. 2 is a cross section of the shrinkfit band 12 and the faceplate 16 taken along line 2—2 of FIG. 1. Before it is tensioned, the band 12 has a bend 28 which displaces one edge of the band at an angle of about 6° to 9° away from the plane of the band. The bend 28 extends completely around the band. The advantages of the bend 28 can be appreciated from FIG. 2, which shows a broken-away section of the faceplate to be protected. The process of manufacturing the panel 16 utilizes a two-piece mold in which glass is molded to form the panel. Because the mold is a two-piece mold, the mold match line 26 is formed around the complete periphery of the panel 16 at the point where the two pieces of the mold meet. Also, an outside surface 30 of the open portion where the panel 16 joins the funnel is disposed at the angle $\beta$ with respect to the upper sidewall surface 32 which joins the viewing portion 18. The angle $\beta$ typically is 5.5° and is utilized because it eases the manufacturing process by making it easier to remove the molded faceplate panel from the mold. Since the bend angle of the band exceeds the angle $\beta$ by about 0.5° to 3.5° before being positioned on the sidewall, when the shrinkfit band 12 cools, both of the edges 34 and 36 contact the surface 32 and 30, respectively, of the faceplate panel 16. As the band continues to cool it shrinks to the shape of the sidewall 20 so that almost the entire surface of the band is tightly drawn against the sidewall with the bend area 28 aligned with and overlying the mold match line 26.

The shrinkfit band 12, as described above, is similar to that described in U.S. Pat. No. 5,064,394 issued on Nov. 12, 1991 to H.R. Swank, which is assigned to the assignee of the present invention and is incorporated by reference herein for the purpose of disclosure. The present shrinkfit band 12 differs from the prior band in that a plurality of mounting loops 40 are formed in the band. In the first embodiment, shown in FIGS. 1-3, the mounting loops 40 overlie the corners 22 of the faceplate panel 16 and, preferably, but not necessarily, extend across the entire width of the shrinkfit band 12.

Figure 4:
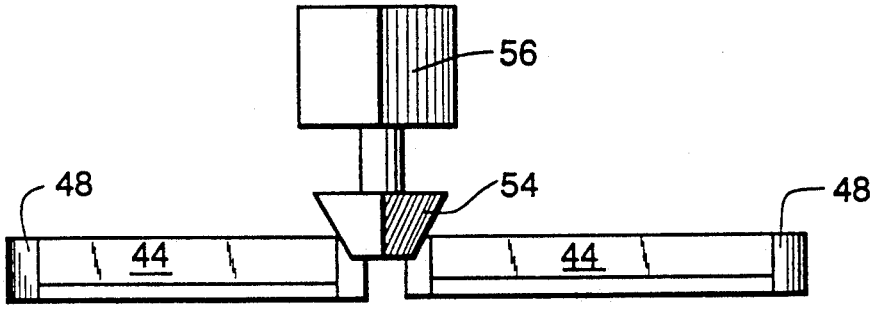
FIG. 4 is a simplified side view of a stretching and forming apparatus.
Figure 5:
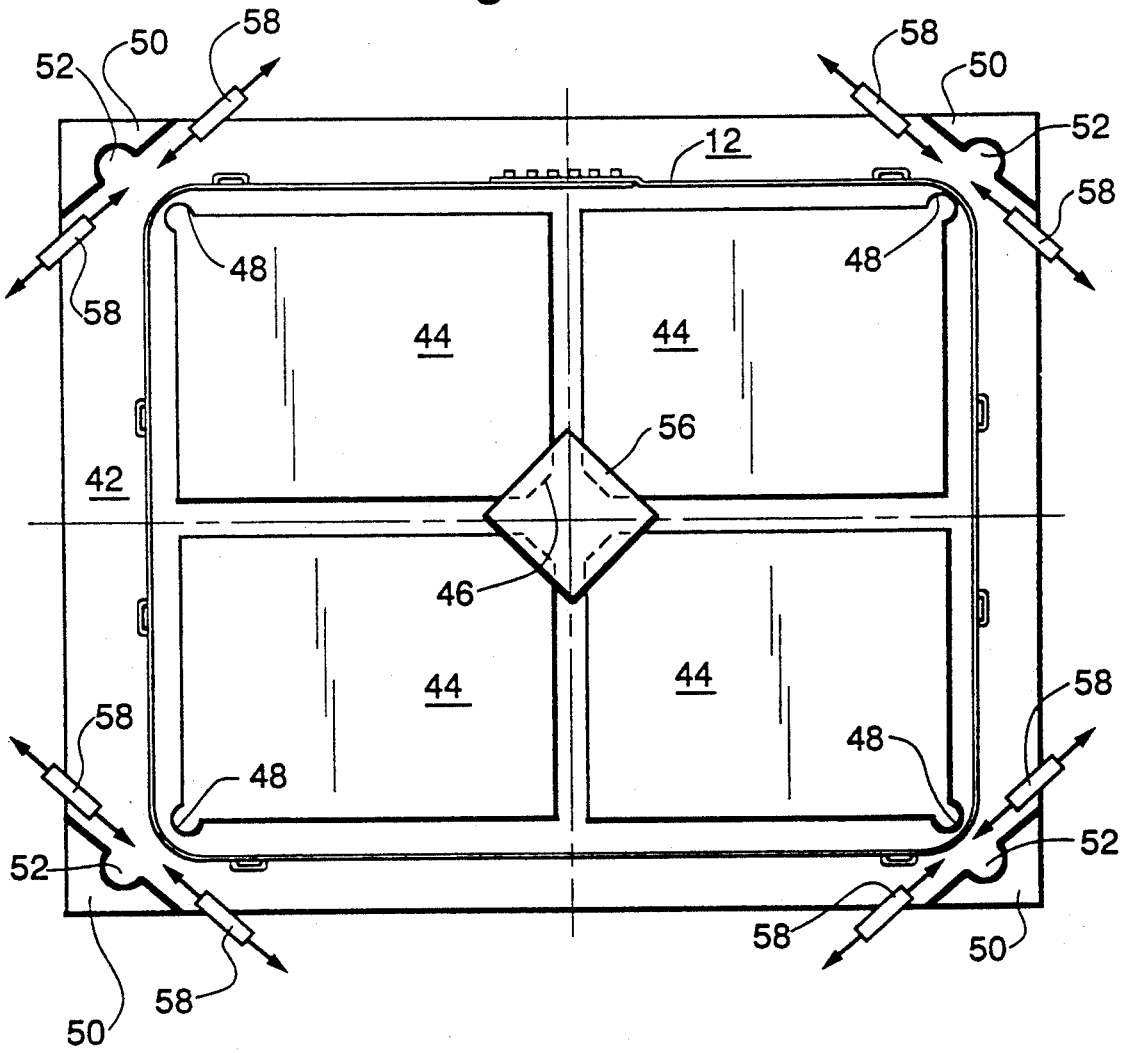
FIG. 5 is a top view of the apparatus shown in FIG. 4.

The mounting loops 40 are formed by stretching the band 12, using the apparatus shown in FIGS. 4 and 5. The shrinkfit band 12 is supported in some convenient manner, such as on a support 42. Four plates 44 are arranged to lie within the rectangular loop formed by the band 12. The plates are slideably affixed to the support 42, and are slideable in a direction parallel to the diagonals of the support, and thus to those of the band 12 after it is formed. The plates 44 are each shaped as one quarter of the band and thus form and dimension the band as desired. The plates are spaced apart a small distance and can have a corner removed to form a bevel 46. The bevels are parallel to the diagonals of the support 42. A boss 48 having a substantially hemispherical shape is provided on the corners of the plates 44 which lie along the diagonals of support. Four plates 44 are arranged to lie within the rectangular loop formed by the band 12 on the support. Four dies 50, each having a boss-receiving recess 52, are attached to the corners of the support. A wedge 54 is arranged between the bevels 46 and is urged against the plates 44 by a cylinder 56. Actuation of the cylinder 56 urges the wedge 54 between the plates 44 and causes the plates to move against, stretch and shape the band 12. The bosses 48 force the contacted portions of the band 12 into the recesses 52 forming open channels (not shown). The travel distance of the plates 44 is accurately established by controlling the stroke of the cylinder 56. The band 12 is thus laid around the plates 44 and the cylinder 56 is actuated to move the plates 44 a distance sufficient to stretch the band. The bosses 48 extrude the corners of the band 12 to form open channels. After the band is stretched, the cylinder 56 is retracted and crimping members 58, associated with each of the corner-located dies 50 and slideable in a direction normal to the diagonals, close the lower portion of the channels by forcing the opposite sides thereof together to form the mounting loops 40. The contacting sides of the lower, abutting portion of each channel are secured together, for example by welding, mechanical crimping or riveting, to provide structural integrity to the mounting loops 40, so that the loops 40 do not relax and open during the application of the band 12 to the tube 10. The loops 40 in this embodiment extend across the entire width of the band 12. Typically, the band has a thickness of about 1.6 mm and a width sufficient to provide the desire tension in the band. The diameter of the opening through each of the loops 40 is sufficient to accommodate a mounting bolt or screw (not shown).

Figure 6:
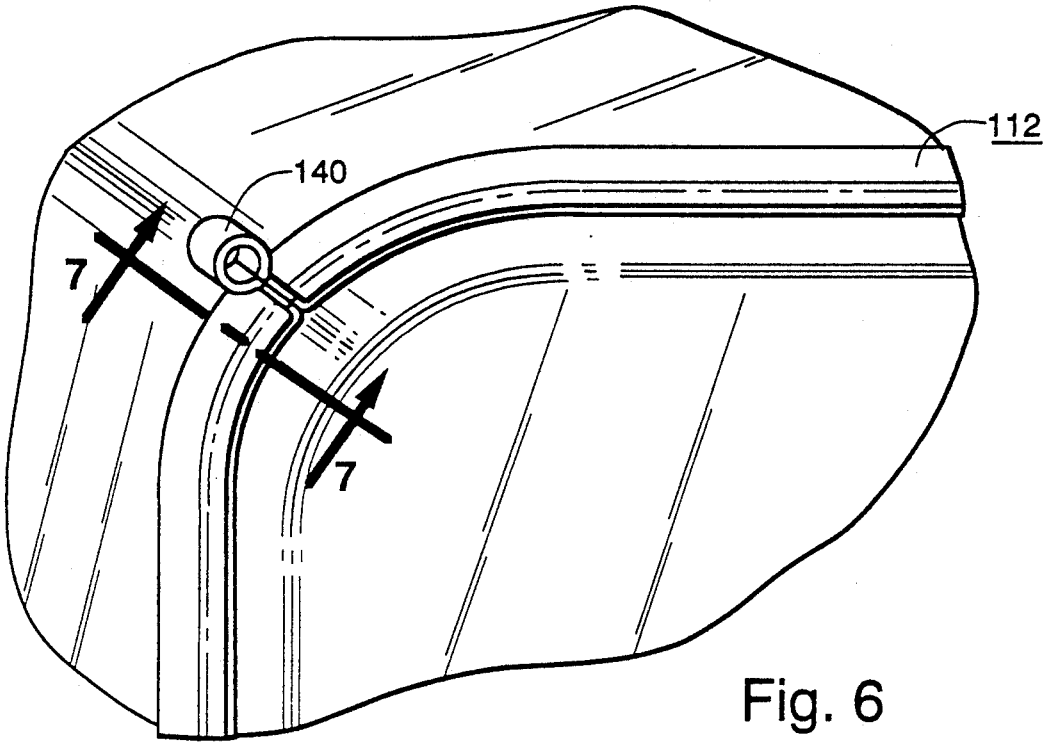
FIG. 6 is a partial perspective view of a forward portion of a CRT showing a second embodiment of a shrinkfit implosion protection band having integral mounting loops formed in the corners of the band and extending across less than the entire width of the band.
Figure 7:
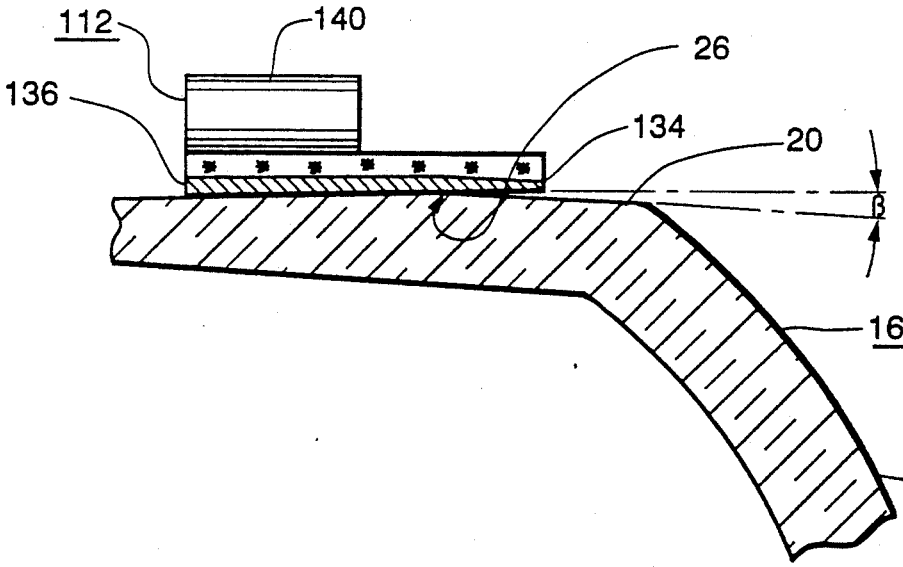
FIG. 7 is a sectional view taken along line 7—7 of FIG. 6.

A second embodiment of an implosion-resistant shrinkfit band 112 is shown in FIGS. 6 and 7. The shrinkfit band 112 is similar to the shrinkfit band 12 in all aspects, except that the mounting loops 140 extend across less than the entire width of the band 112. Such a band structure is provided by removing a portion of each of the mounting loops 140, in this instance from the front section of the band 112 so that the loop 140 extends from the rear edge 136 and terminates before the front edge 134. The resultant structure will permit the sidewall 20 of the faceplate panel 16 to be pushed at least partially through the front of the receiver cabinet. Such a push-through configuration is utilized, for example, in Europe.

Figure 8:
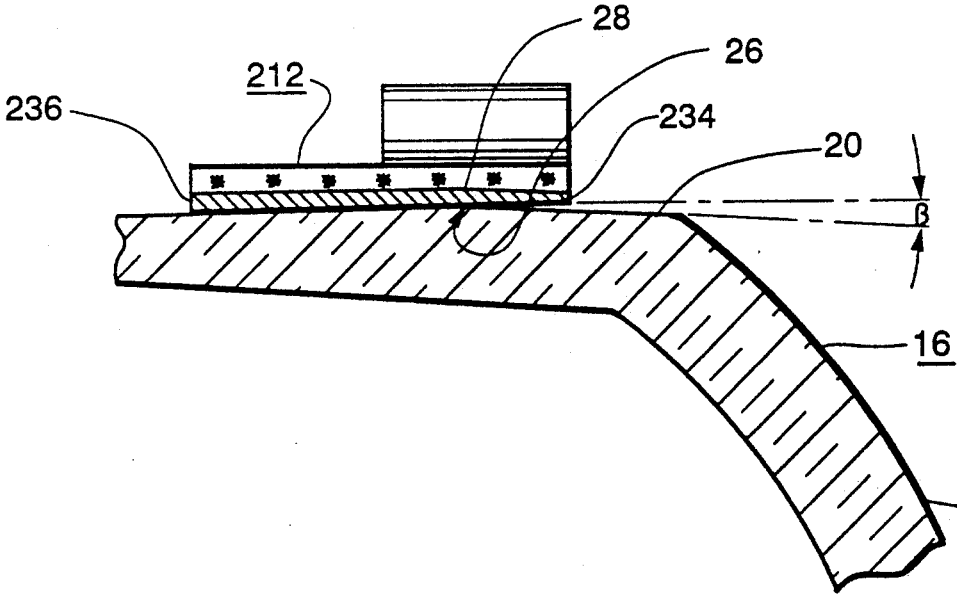
FIG. 8 is a sectional view of a portion of a shrinkfit implosion protection band showing another embodiment in which the mounting loops extend across less than the entire width of the band.

FIG. 8 shows a variation on the previous embodiment. The band 212 is similar to the shrinkfit band 12 in all aspects, except that the rear portion of each of the mounting loops 240 is removed to facilitate the use of shorter mounting bolts (not shown). Such a configuration may be used, for example, on very large size tubes where the band width is in excess of 5 cm. The resultant loop 240 extends from the front edge 234 and terminates before the back edge 236 of the band 212.

Figure 9:
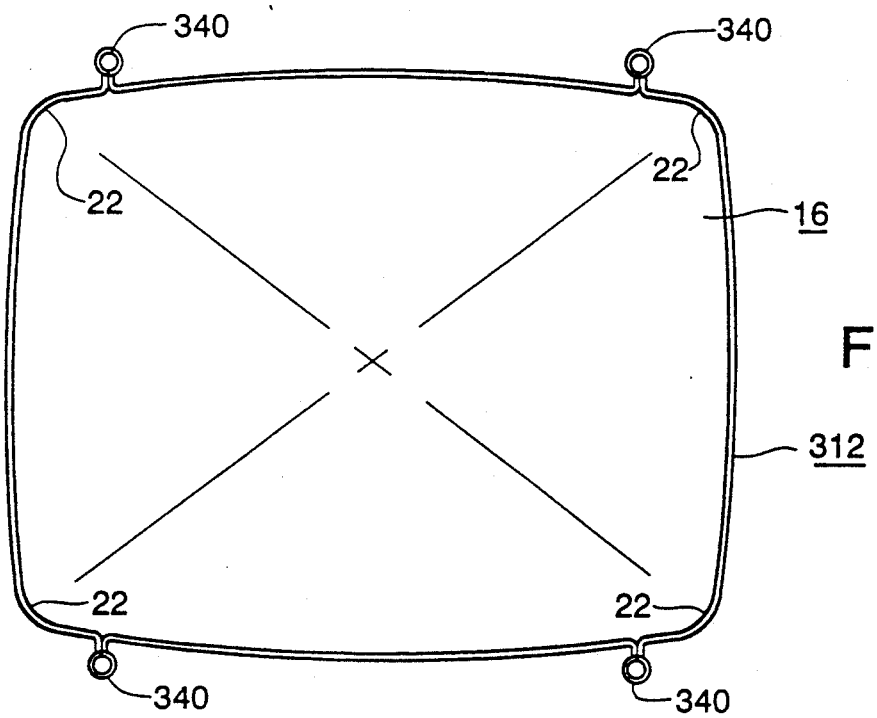
FIG. 9 is a front elevation view illustrating the viewing portion of the CRT faceplate and the shrinkfit implosion band with integral mounting loops located along flattened portions of the faceplate panel sidewall.

FIG. 9 shows a fourth embodiment of an implosion protection band 312 which is similar to the shrinkfit band 12 in all aspects, except that the mounting loops 340 are formed in the portions of the band that overlies the flattened portions 24 of the sidewall 20 of the faceplate 16. Preferably, the mounting loops are formed along the oppositely disposed long sides of the band 312 about 2.5 to 7.6 cm from the corners 22. This configuration of the band permits the tube to be mounted in a cabinet with narrower dimensions than is possible if the mounting lugs are located at the corners of the band.

Figure 10:
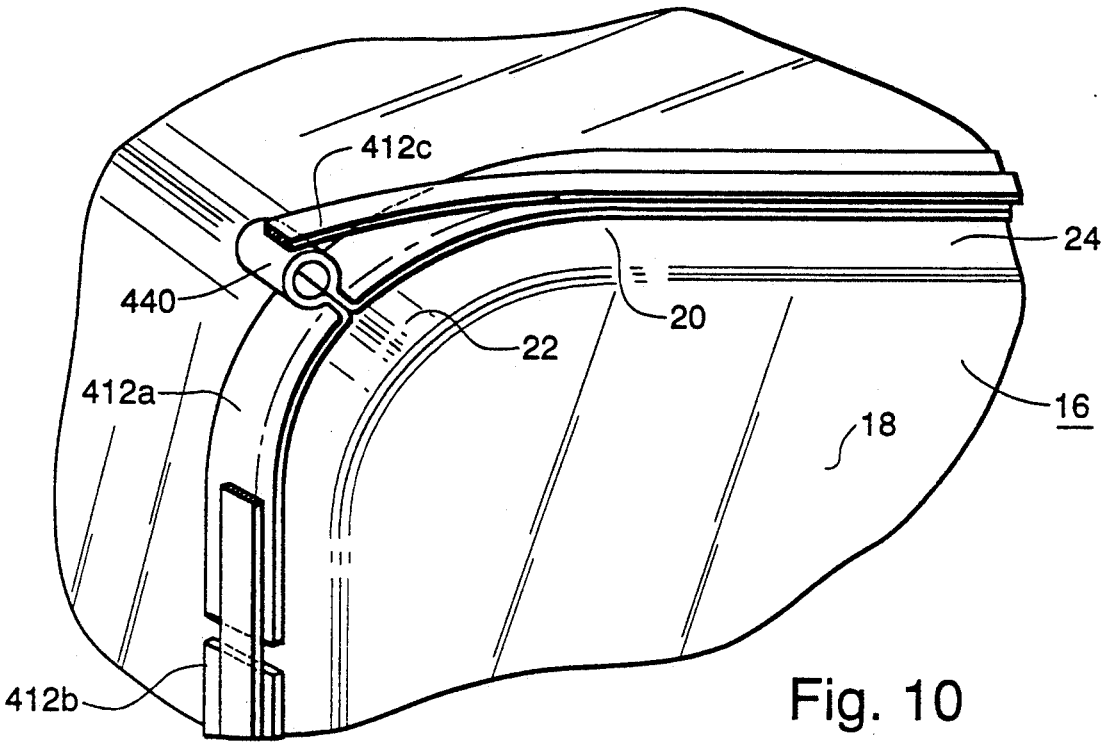
FIG. 10 is a partial perspective view of the forward portion of the CRT showing a two-piece rimband having integral mounting loops formed in the corners of the rimband and extending across the entire width of the band.

While described so far in the context of a shrinkfit band, the invention is not so limited and may, for example, be used with a pair of half-shell, split rimbands **412*a* and 412*b*. An adhesive (not shown) is provided around the sidewall 20 of the faceplate panel 16. The adhesive may comprise double-sided tape or any suitable adhesive known in the art. The pair of rimbands 412*a* and 412*b* are oppositely positioned on the sidewall 20 to contiguously surround the viewing portion 18 of the faceplate panel 16. The rimbands are secured to the sidewall by at least one tension band 412*c*, as is known in the art. The present rimbands 412*a* and 412*b* differ from prior rimbands, such as those described in U.S. Pat. No. 5,055,934, referenced above, in that the present rimbands 412*a* and 412*b* have mounting loops 440 formed therein. While FIG. 10 shows the mounting loops 440 located at the corners 22 of the panel 16, it is within the scope of this invention to locate the mounting loops along the sides of the rimbands, overlying the substantially flat portions 24 of the sidewall 20. Also, the mounting loops 440, preferably, but not necessarily, extend across the entire width of the split rimbands 412*a* and 412*b***.

What is claimed is:

1. In an implosion-resistant cathode-ray tube having an evacuated envelope with a faceplate panel, said faceplate panel including a substantially rectangularly-shaped viewing portion extending to a peripheral sidewall, said sidewall having corners and oppositely disposed flattened portions, and implosion protection means extending around said sidewall and having a predetermined width, wherein the improvement comprises said implosion protection means having a plurality of mounting loops formed therein, in the direction of said width, to accommodate mounting means, each of said mounting loops being closed adjacent to said sidewall to ensure the structural integrity of said implosion protection means.

2. The implosion-resistant cathode-ray tube described in claim 1 wherein said mounting loops are closed by fixedly securing together abutting portions of said implosion protection means.

3. The implosion-resistant cathode-ray tube described in claim 2 wherein said mounting loops are located at the corners of said panel sidewall.

4. The implosion-resistant cathode-ray tube described in claim 2 wherein said mounting loops are located along said flattened portions of said sidewall.

5. The implosion-resistant cathode-ray tube described in claim 4 wherein said flattened portions of said sidewall are located along two longer sides of said rectangular faceplate.

6. The implosion-resistant cathode-ray tube described in claim 1 wherein said implosion protection means comprises a shrinkfit band.

7. The implosion-resistant cathode-ray tube described in claim 1 wherein said implosion protection means comprises a pair of split rimbands.

8. In an implosion-resistant cathode-ray tube having an evacuated envelope with a faceplate panel, said faceplate panel including a substantially rectangularly-shaped viewing portion extending to a peripheral sidewall with four corners extending into flattened portions, and a shrinkfit band extending perimetrically around said sidewall and having a width extending from a front edge to a rear edge thereof, wherein the improvement comprises:

said band having a plurality of mounting loops formed therein, in the direction of said width, to accommodate tube mounting means, each of said mounting loops being closed adjacent to said sidewall to ensure the structural integrity of said band.

9. The implosion-resistant cathode-ray tube described in claim 8 wherein said mounting loops are closed by fixedly securing together abutting surfaces of said band.

10. The implosion-resistant cathode-ray tube described in claim 9, wherein said mounting loops are located at the corners of said panel.

11. The implosion-resistant cathode-ray tube described in claim 9 wherein said mounting loops are located along said flattened portions of said sidewall.

12. The implosion-resistant cathode-ray tube described in claim 11 wherein said flattened portions of said sidewall are located along the two longer sides of said faceplate panel.

13. The implosion-resistant cathode-ray tube described in claim 9 wherein said mounting loops extend for the entire width of said band.

14. The implosion-resistant cathode-ray tube described in claim 9 wherein said mounting loops extend for less than the width of said band.

15. The implosion-resistant cathode-ray tube described in claim 14 wherein said mounting loops extend from said front edge of said band and terminate before said back edge thereof.

16. The implosion-resistant cathode-ray tube described in claim 14 wherein said mounting loops extend from said rear edge of said band and terminate before said front edge thereof.

* * * * *